US007156034B2

(12) United States Patent
Mizutani

(10) Patent No.: US 7,156,034 B2
(45) Date of Patent: Jan. 2, 2007

(54) STEERING SYSTEM FOR BOAT

(75) Inventor: Makoto Mizutani, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/074,805

(22) Filed: Mar. 8, 2005

(65) Prior Publication Data

US 2005/0199167 A1 Sep. 15, 2005

(30) Foreign Application Priority Data

Mar. 9, 2004 (JP) ..... 2004-065706

(51) Int. Cl.
*B63H 25/06* (2006.01)

(52) U.S. Cl. ..... 114/162; 440/1

(58) Field of Classification Search ..... 114/162; 440/1

See application file for complete search history.

(56) References Cited

U.S. PATENT DOCUMENTS 3,349,744 A * 10/1967 Mercier et al. ..... 114/150
4,120,258 A * 10/1978 Spurgin ..... 114/144 E
4,787,867 A 11/1988 Takeuchi et al.
4,872,857 A 10/1989 Newman et al.
4,908,766 A 3/1990 Takeuchi
5,235,927 A * 8/1993 Singh et al. ..... 114/144 E
5,244,426 A 9/1993 Miyashita et al.
5,253,604 A 10/1993 Bohlin
6,230,642 B1 5/2001 McKenney et al.
6,234,853 B1 5/2001 Lanyi et al.
6,273,771 B1 8/2001 Buckley et al.
6,402,577 B1 6/2002 Treinen et al.
6,535,806 B1 3/2003 Millsap et al.
6,655,490 B1 12/2003 Andonian et al.
6,671,588 B1 * 12/2003 Otake et al. ..... 701/3
6,678,596 B1 1/2004 Husain et al.
6,843,195 B1 1/2005 Watabe et al.
6,892,661 B1 5/2005 Kishi et al.
6,892,662 B1 5/2005 Watanabe et al.
2003/0150366 A1 8/2003 Kaufmann et al.
2003/0224670 A1 12/2003 Takada et al.
2003/0224672 A1 12/2003 Takada et al.

(Continued)

FOREIGN PATENT DOCUMENTS

JP B-HEI 6-33077 5/1994

(Continued)

OTHER PUBLICATIONS

Co-Pending U.S. Appl. No. 11/075,131, filed Mar. 8, 2005. Title: Electric Steering Apparatus for Watercraft. Inventor: Makoto Mizutani.

(Continued)

*Primary Examiner*—Stephen Avila
(74) *Attorney, Agent, or Firm*—Knobbe, Martens, Olson & Bear, LLP

(57) ABSTRACT

A steering system for a boat can include a main switch for turning power on and off, an emergency stop switch for stopping an engine, a steering wheel for operation by an operator, a steering wheel displacement sensor for detecting the operator's displacement of the steering wheel, a rudder device with an electric actuator for providing a force to move a rudder about a rotational shaft according to the detected steering wheel displacement, and a controller for outputting a signal to drive the electric actuator according to the detected steering wheel displacement. The controller can drive the electric actuator of the rudder device to return the rudder to its center position when the engine is stopped by the main switch or an auxiliary stop switch.

10 Claims, 3 Drawing Sheets

U.S. PATENT DOCUMENTS

| | | | |
|---|---|---|---|
| 2004/0031429 | A1 | 2/2004 | Kaufmann et al. |
| 2005/0170712 | A1 | 8/2005 | Okuyama |
| 2005/0199169 | A1 | 9/2005 | Mizutani |

FOREIGN PATENT DOCUMENTS

| | | | |
|---|---|---|---|
| JP | 2739208 | B2 | 1/1998 |
| JP | 10-226346 | | 8/1998 |
| JP | 2959044 | B2 | 7/1999 |
| JP | 02-227395 | | 9/1999 |
| JP | 2000-318691 | | 11/2000 |
| JP | 2003-313398 | | 11/2000 |
| JP | A-2002-331948 | | 11/2002 |

OTHER PUBLICATIONS

Co-Pending U.S. Appl. No. 11/075,129, filed Mar. 8, 2005. Title: Steering Assist System for Boat. Inventor: Makoto Mizutani.

Co-Pending U.S. Appl. No. 11/384,616 filed Mar. 20, 2006. Title: Steering Control System For Boat.

Co-Pending U.S. Appl. No. 11/354,491 filed Feb. 15, 2006. Title: Steering Control System For Boat.

Co-Pending U.S. Appl. No. 11/089,929 filed Mar. 25, 2005. Now published as US 2005-0215131A1 (submitted herewith). Title: Steering System of Outboard Motor.

Co-Pending U.S. Appl. No. 11/155,757 filed Jun. 17, 2005. Now published as US 2005-0282447A1 (submitted herewith). Title: Steering Device for Small Watercraft.

Co-Pending U.S. Appl. No. 11/047,098 filed Jan. 31, 2005. Now published as US-2005-0170712-A1 (submitted herewith). Title: Method and System for Steering Watercraft.

Co-Pending U.S. Appl. No. 11/047,123 filed Jan. 31, 2005. Now published as US-2005-0170713-A1 (submitted herewith). Title: Method and System for Steering Watercraft.

* cited by examiner

STEERING SYSTEM FOR BOAT

PRIORITY INFORMATION

This application is based on and claims priority under 35 U.S.C. §119 to Japanese Patent Application No. 2004-065706, filed on Mar. 9, 2004, the entire contents of which is hereby expressly incorporated by reference herein.

BACKGROUND OF THE INVENTIONS

1. Field of the Inventions

The present inventions relate to an steering system for a small boat, and in particular, to electric steering systems for boats.

2. Description of the Related Art

Japanese Patent No. JP-B-2959044 discloses a steering system for a watercraft using an electric motor in place of a hydraulic mechanism, for steering an outboard motor-powered small boat. This electric steering system is adapted such that the electric motor is driven by an electric current command signal corresponding to a turning angle of a steering wheel based on operator's steering wheel operation, to rotate the outboard motor for steering.

In this electric-motor-driven steering system, however, since the electric motor is driven via an electric cable from the steering wheel, the steering wheel is not returned to its center position after the operator operates it to change the running direction of the boat. This requires the operator to return the steering wheel, providing less satisfactory operability.

Further, the outboard motor is better drained when stored with the body placed in the center position within its turning range about the swivel shaft, which is preferable for transportation. It is thus necessary to return the outboard motor to its center position after docking. However, the conventional electric steering system for an outboard motor is adapted such that it is not operable when the engine is stopped and power is turned OFF. The operator, therefore, is required to return the outboard motor to its center position before he/she turns the power OFF, which takes time and effort. If the operator forgets to return the motor to the center position before shutting down the engine, the operator must restart the engine long enough to turn the motor, then again powered down the engine.

Further, in the case that the engine is stopped by an emergency or "auxiliary" stop switch such as a safety switch during cruising at high speed, the motor and propeller will stop immediately, but the steering angle of the motor will not change. Thus, if this occurs during a turn, the boat will continue to coast with the outboard motor, acting as a rudder, disposed at a turning angle. Thus, the boat will coast into a turn; potentially giving the operator and/or passengers an uncomfortable feeling.

Japanese Patent Publication No. 2002-331948 discloses an electric power steering system for a land vehicle with an assist motor which returns the wheels and steering wheel to their center positions after the driver turns the steering wheel. This land vehicle vehicular power steering system controls steering motion when the vehicle is running and when the engine is driven with a main switch ON. However, this system does not operate at all, nor does it need to work when the engine is stopped.

SUMMARY OF THE INVENTION

An aspect of at least one of the embodiments disclosed herein includes the realization that advantageous conveniences are provided to a watercraft operator by providing automatic return of the rudder, and optionally the steering wheel, to their center positions and/or by continuing operation of the electric steering system when a main switch of the boat is OFF during docking or when the engine is stopped by the emergency stop switch. Thus, in some embodiments, a steering system for a small boat is capable of returning a steering wheel and a rudder to their center positions without taking user's time and effort after engine stop, and allowing the operator to steer promptly and appropriately when the engine is stopped by an auxiliary stop switch.

In accordance with an embodiment, a steering system for a boat comprises a main switch for turning power on and off, an auxiliary stop switch for urgently stopping an engine, and a boat speed sensor for detecting running speed of the boat. A steering wheel is configured to be operated by an operator of the boat. A steering wheel displacement sensor is configured for detecting a displacement of the steering wheel. A rudder device with an electric actuator is configured to provide a force to move a rudder about a rotational shaft according to the detected steering wheel displacement. Additionally, a controller is configured to output a signal to drive the electric actuator according to the detected steering wheel displacement, wherein the controller is configured to drive the electric actuator of the rudder device to return the rudder to its center position when the engine is stopped by the main switch or the emergency stop switch.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENT

Figure 1:
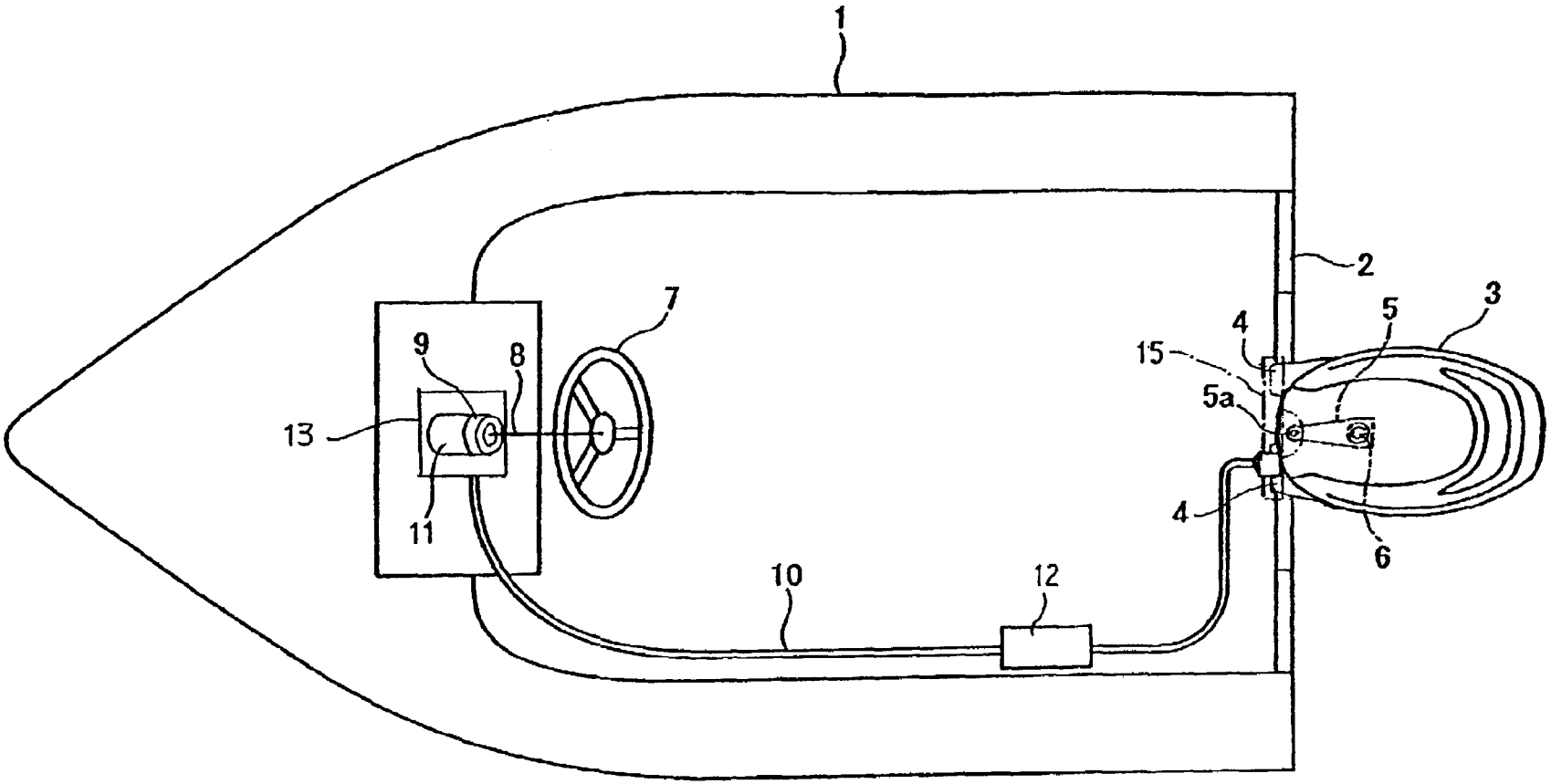
FIG. 1 is a schematic top plan view of a watercraft having a steering system in accordance with an embodiment.

FIG. 1 is a schematic top plan view of a small boat including an outboard motor with which the present embodiments are applicable. The embodiments disclosed herein are described in the context of a marine propulsion system of a small boat because these embodiments have particular utility in this context. However, the embodiments and inventions herein can also be applied to other marine vessels, such as personal watercraft and small jet boats, as well as other vehicles.

An outboard motor 3 is mounted to a transom plate 2 of a hull 1 through clamp brackets 4. The outboard motor 3 is rotatable about a swivel shaft 6. A steering bracket 5 is fixed to an upper end of the swivel shaft 6. A rudder device 15 is connected to an end 5*a* of the steering bracket 5.

The rudder device 15 includes, for example, a DD (Direct Drive) type electric motor including a motor body (not shown). The motor body slides along a threaded shaft (not shown) that can be oriented generally parallel to the transom plate 2. The steering bracket 5 is connected to the motor body to allow the outboard motor 3 to rotate about the swivel shaft 6 in conjunction with the sliding motion of the motor body.

A steering wheel 7 is provided in the vicinity of an operator's seat on the hull 1. A steering wheel control section 13 can be provided at the root or base of a steering column shaft 8 of the steering wheel 7, however other locations can also be utilized. A steering wheel displacement (e.g. operation angle) sensor 9 and a reaction torque motor 11 can be provided inside the steering wheel control section 13. The steering wheel control section 13 can be connected, via a signal cable 10, to a controller 12, which in turn is connected to the rudder device 15.

The controller 12 can be configured to calculate a steering angle based on a detection signal from the steering wheel operation angle sensor 9. The calculated steering angle is sent to the rudder device 15 as an electric command signal, to drive the rudder device 15 so as to allow the outboard motor 3 to rotate about the swivel shaft 6 for boat steering.

A load sensor 16 (See FIG. 2) that can be provided in the outboard motor 3 or the rudder device 15 itself, can be configured to detect an external force F (See FIG. 2) exerted on the outboard motor 3. The controller 12 can be configured to calculate a target value of reaction torque to be exerted to the steering wheel 7 by the reaction torque motor 11 based on the external force. The controller 12 then drives the reaction torque motor 11 in accordance with the target torque, thereby applying a reaction force corresponding to the external force to the steering wheel 7.

Figure 2:
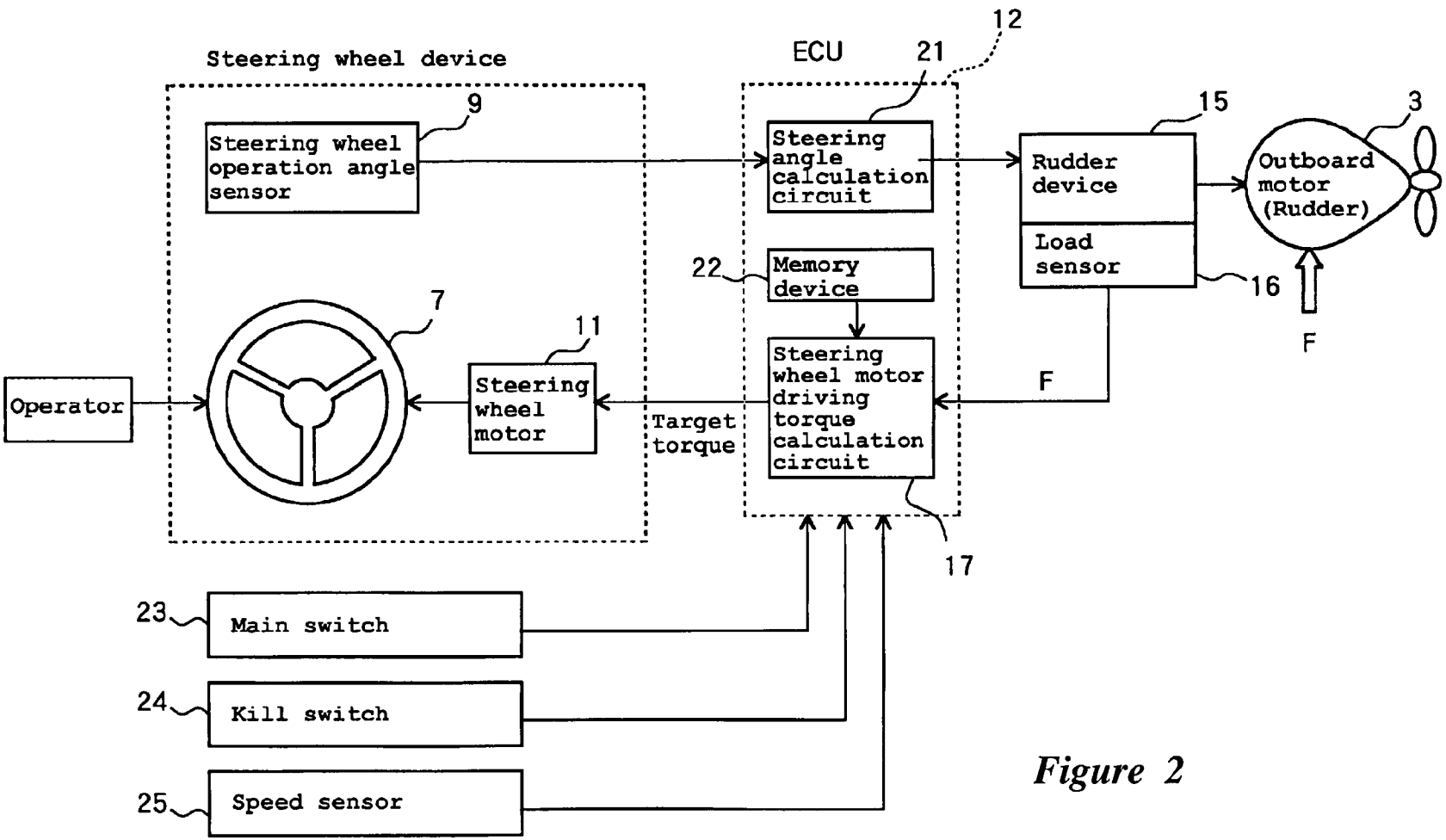
FIG. 2 is a block diagram of an electric steering system according to the embodiment of FIG. 1.

FIG. 2 is a block diagram of a steering system according to an embodiment of the present invention.

When an operator rotates the steering wheel 7, the rotated angle is detected by the steering wheel operation angle sensor 9. Based on the detection signal, a steering angle calculation circuit 21 of the controller (ECU) 12 calculates a steering angle as will be described later, and converts it into an electrical current value to drive the electric motor (not shown) of the rudder device 15. This allows the outboard motor 3 to swing about the swivel shaft 6 (See FIG. 1), to change the direction of the boat.

While the outboard motor 3 rotates, an external resistance (external force) F as a reaction force is applied to the outboard motor 3. The load sensor 16 detects the external force F, and data of which is sent to a reaction torque calculating circuit 17. Based on the data for the detected external force, a target torque is calculated and the reaction torque motor 11 is so driven as to apply such target torque. This causes a reaction force corresponding to the steering operation to be applied to the steering wheel 7 so that the operator can steer the steering wheel while feeling the reaction force in response to the steering wheel operation.

The outboard motor 3 functions as a rudder when it rotates about the swivel shaft. In this case, the steering angle calculating circuit 21 calculates the displacement of the rudder or the steering angle (e.g. rudder angle) based on the steering wheel turning angle a detected by the steering wheel operation angle sensor 9.

The steering wheel motor 11 can function as a reaction-torque motor to apply a reaction force corresponding to operator's steering operation to the steering wheel 7, as noted above. The steering wheel motor 11 can also function as a return motor to allow the steering wheel to return to its center position after the operator turns the steering wheel for steering.

The return motion of the steering wheel 7 can be executed as described below, although other techniques can also be used.

During operation, when the operator turns the steering wheel 7, an angle of the turn is detected by the steering wheel operation angle sensor 9. If the steering wheel is determined to be turned by a specified angle or greater, the steering wheel motor 11 is driven to produce a specified return torque in the direction of returning the steering wheel to its center position. Other techniques can also be used to determine the desired return torque.

The return torque can be sufficiently low so as to be controlled or countered by human hands so as to allow the operator to countersteer against it. In some embodiments, the return torque produced by the steering wheel motor 11 is reduced to zero or about zero when the steering wheel returns to a specified angular range in the vicinity of its center position. That is, no or almost no return force is applied to the steering wheel within such specified angular range. This provides a further advantage in the following scenario as well as other scenarios:

During operation, a boat receives a certain deflecting force at its rudder (e.g. outboard motor) resulting from rotation of a propeller that constantly deflects the boat into a certain running direction (paddle-rudder effect). Because of this paddle-rudder effect, when a steering angle is zero, or the steering wheel is positioned at its center position, the boat runs in a direction that is biased generally constantly toward one side. Thus, to run the boat straight ahead, the operator is required to turn the steering wheel by a specified angle against the force caused by the paddle-rudder effect and hold such state. In this case, when such return force is applied to the steering wheel, a counterforce against the return force is also required, which requires the operator to exert a larger force to hold the steering wheel. This increases burdens on the operator, resulting in fatigue, and continually draws electrical power. Thus, in some embodiments, no return force is applied to the steering wheel within the specified angular range in the vicinity of its center position.

The steering wheel motor driving torque calculation circuit 17 of the controller 12 can be configured to calculate a torque to apply a return force to the steering wheel 7, as well as a reaction force against the steering wheel 7 as described above. A program and a map for calculating such reaction force and return force can be stored in a memory device 22 along with a program for controlling the steering system after engine stop, described in greater detail below. These stored reaction force and return force values can be read by the calculation circuits 17, 21, respectively, for calculation of the driving amounts of the steering wheel motor 11 and the electric motor of the rudder device 15, respectively.

The controller 12 can be connected to a main switch 23, a kill switch 24 and a speed sensor 25. The main switch 23 is configured to provide power ON and OFF switching for the engine. The kill switch 24 can include an emergency stop switch or an "auxiliary" stop switch such as a safety switch or other stop switches. In some embodiment, the kill switch 24 can incorporate a "lanyard" that can be tethered to the operator during operation.

The speed sensor 25 can be configured to detect boat speed. The calculation circuits 17, 21 of the controller 12 can be configured to read data indicating ON/OFF states of the main switch and kill switch, as well as data on boat speed for controlling the steering wheel motor 11 and the electric motor of the rudder device 15 after engine stop, in accordance with the programs stored in the memory device 22.

In some embodiments, when the main switch 23 or the kill switch 24 is activated to stop the engine, the controller 12 continues to provide power to the steering system for a specified period of time by means of a timer (not shown) so that the steering system is operable. In some embodiments, the controller 12 can be configured to hold the main power on for the specified period of time. When in this state, the electric motor of the rudder device 15 can be driven so as to return the rudder (outboard motor 3) to its center position. Such return motion of the rudder can be executed by a return control circuit (not shown) included in the controller 12, for example, in accordance with a predetermined program.

In some embodiments, the return control circuit of the controller 12 can execute the return motion of the rudder, and drive the steering wheel motor 11 to return the steering wheel 7 to its center position. In this embodiment, the system can be arranged such that no return turning force is applied to the steering wheel by the steering wheel motor 11 within a specified turning angular range in the vicinity of its center position, as with the forgoing steering wheel return motion during ordinary running, or a return torque is applied to the steering wheel 7 until it returns to its exact center position.

In such state, the boat coasts while the engine is stopped. In this case, when the operator attempts to change the running direction of the boat by operating the steering wheel, the return motion of the rudder and the steering wheel return motion are stopped so that the steering through operator's steering wheel operation is allowed as with during ordinary operation. For example, the steering wheel operation angle sensor 9 detects an angle of the turn of the steering wheel 7, based on which the steering angle calculation circuit 21 calculates a steering angle to drive the electric motor of the rudder device 15. The operator can thus change the running direction of the boat while it coasts, thereby making adjustments to its direction when needed due to wind and ocean current during docking or the like.

Further, when the boat is running at high speed, in the case that the kill switch 24 is turned OFF so that the engine is stopped, the amount of command electric current to the electric motor increases to return the rudder to its center position at high speed. Thus, in the case that the operator activates the kill switch or another auxiliary switch for stopping the engine during running at high speed, or the like, the rudder returns to its center position at high speed, thereby comfortably returning the boat to a straight ahead heading.

Figure 3:
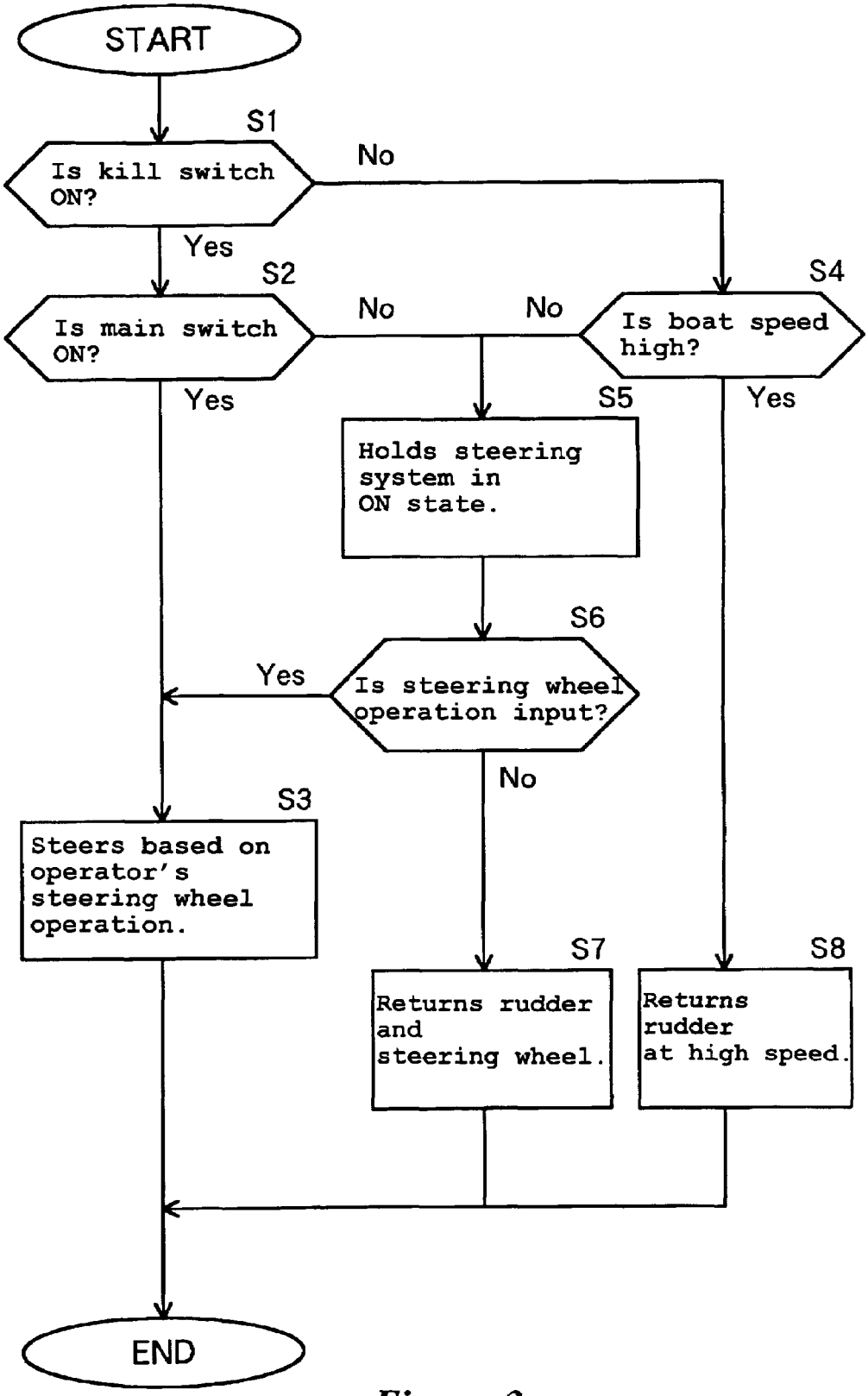
FIG. 3 is a flowchart of a routine that can be used with the embodiment of FIG. 1.

FIG. 3 is a flowchart showing an operational example of the electric steering system according to an embodiment.

In step S1, a determination can be made as to whether or not the kill switch is in an ON state. If it is ON, which means an ordinary operating state, the process proceeds to the step S2. If it is OFF, which means that the engine is to be stopped, the process goes to the step S4.

In step S2 a determination can be made as to whether or not the main switch is in an ON state. If it is ON, which means an ordinary operating state, the process proceeds to the step S3. If it is OFF, which means that the engine is stopped or is in the process of stopping, the process proceeds to the step S5.

In step S3, the steering system provides normal steering control for ordinary operation, the rudder device 15 is driven based on operator's steering wheel operation to steer the outboard motor 3.

In step S4, a determination can be made as to whether or not boat speed is in a higher range. Such a determination of boat speed can be made simply as to whether the boat speed is above or below a predetermined boat speed. In some embodiments, a highly accurate boat speed sensor is not required. Further, boat speed may be determined based on engine speed. For example, if the engine speed is at a high rpm, then the boat speed can be presumed to be high, and when the engine speed is at a low RPM, the boat speed can be presumed to be low. In this case, an engine speed sensor is used in place of the boat speed sensor to determine the boat speed. However, other techniques can also be used.

In step S5, when the kill switch 24 or the main switch 23 is turned OFF so that power is cut off and the engine is stopped, the power supply to the steering system continues. This can be executed in a way such that the power circuit is held in an ON state for a specified period of time by means of the timer after the kill switch or the main switch is detected to be OFF. Other techniques can also be used. For example, but without limitation, another switch (not shown) can be used to provide power only to the steering system, and/or other selected systems.

In step S6, a determination can be made as to whether or not the steering wheel is operated while the boat is coasting after the engine stop. Such determination can be made in a way such that when the operator turns the steering wheel, an angle of the turn is detected and input as a detection signal to the controller 12 by the steering wheel operation angle sensor 9. If steering wheel operation is input, the process goes to the step S3. If not, it goes to the step S7.

In step S7, when no steering wheel operation is input while the boat is coasting in the above step S6, the rudder and the steering wheel are returned to their center positions.

In step S8, when the boat speed is high (as determined in step S4), for example, when the kill switch is turned OFF while the boat is running at high speed, the rudder is returned to its center position at high speed.

The present invention can be effectively applied to a small boat having an outboard motor or a stern drive, particularly to a steering system using an electric motor. However, although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A steering system for a boat comprising a main switch for turning power on and off, an auxiliary stop switch for urgently stopping an engine, a boat speed sensor configured to detect a running speed of the boat, a steering wheel configured to be operated by an operator of the boat, a steering wheel displacement sensor configured to detect a displacement of the steering wheel, a rudder device with an electric actuator configured to provide a force to move a rudder about a rotational shaft according to the detected steering wheel displacement, and a controller configured to output a signal to drive the electric actuator according to the detected steering wheel displacement, wherein the controller is configured to drive the electric actuator of the rudder device to return the rudder to its center position when the engine is stopped by the main switch or the emergency stop switch.

2. The electric steering system according to claim 1, wherein the controller continues power supply to the steering system for a specified period of time when the engine is stopped by the main switch or the emergency stop switch.

3. The steering system according to claim 1, further comprising a steering wheel motor configured to applying a turning force to the steering wheel, wherein the controller is configured to calculate a driving torque for the steering wheel motor and wherein the controller is configured to drive the steering wheel motor to return the steering wheel to its center position when the engine is stopped by the main switch or the emergency stop switch.

4. The steering system according to claim 2, further comprising a steering wheel motor configured to applying a turning force to the steering wheel, wherein the controller is configured to calculate a driving torque for the steering wheel motor and wherein the controller is configured to drive the steering wheel motor to return the steering wheel to its center position when the engine is stopped by the main switch or the emergency stop switch.

5. The steering system according to claim 1, wherein the controller is configured to, when the engine is stopped by the main switch or the auxiliary stop switch, drive the electric motor of the rudder device according to the operator's operation of the steering if the steering wheel is moved.

6. The steering system according to claim 2, wherein the controller is configured to, when the engine is stopped by the main switch or the auxiliary stop switch, drive the electric motor of the rudder device according to the operator's operation of the steering if the steering wheel is moved.

7. The steering system according to claim 3, wherein the controller is configured to, when the engine is stopped by the main switch or the auxiliary stop switch, drive the electric motor of the rudder device according to the operator's operation of the steering if the steering wheel is moved.

8. The steering system according to claim 4, wherein the controller is configured to, when the engine is stopped by the main switch or the auxiliary stop switch, drive the electric motor of the rudder device according to the operator's operation of the steering if the steering wheel is moved.

9. The steering system according to claim 1, wherein when the engine is stopped by the auxiliary stop switch while the boat is running at or above a predetermined high speed, the rudder is returned to its center position at high speed.

10. A steering system for a boat comprising a main switch for turning power on and off, an auxiliary stop switch for urgently stopping an engine, a boat speed sensor configured to detect a running speed of the boat, a steering wheel configured to be operated by an operator of the boat, a steering wheel displacement sensor configured to detect a displacement of the steering wheel, a rudder device with an electric actuator configured to provide a force to move a rudder about a rotational shaft according to the detected steering wheel displacement, a controller configured to output a signal to drive the electric actuator according to the detected steering wheel displacement, and means for returning the rudder to its center position when the engine is stopped by the main switch or the emergency stop switch.

* * * * *